United States Patent [19]

Egan

[11] Patent Number: 4,736,489

[45] Date of Patent: Apr. 12, 1988

[54] PORTABLE HAND VACUUM FOR PICKING UP SMALL METAL PARTICLES

[76] Inventor: James Egan, 64 Andover Rd., Billerica, Mass. 01821

[21] Appl. No.: 908,237

[22] Filed: Sep. 17, 1986

[51] Int. Cl.[4] ..... A47L 5/18

[52] U.S. Cl. ..... 15/409; 417/76

[58] Field of Search ..... 15/409; 417/76, 151

[56] References Cited

U.S. PATENT DOCUMENTS

| | | | |
|---|---|---|---|
| 1,172,450 | 2/1916 | Griffin | 15/409 X |
| 2,055,577 | 9/1936 | Huff | 15/409 X |
| 2,091,642 | 8/1937 | Lingenbrink | 15/409 X |
| 2,856,205 | 10/1958 | Coleman et al. | 15/409 X |

*Primary Examiner*—Chris K. Moore

[57] ABSTRACT

A jet pump vacuum device for picking up debris includes an elongated tubular vacuum member having an input end and an output end and a high pressure air tube for discharging a jet of high pressure air into said elongated vacuum member at a point therein between said input and output ends, whereby said high pressure air discharged flows to said output end and draws ambient air into said input end, the flow of said ambient air into said input end being sufficient to carry said debris into said input end, through said vacuum member and out said output end is adapted with means for varying the position of said point of discharge of high pressure air within said elongated vacuum member. In a preferred embodiment an elongated opening is provided in a side of the elongated vacuum member through which the high pressure tube projects into the elongated vacuum member, means are provided for sealing between the high pressure air tube and the vacuum member opening and the high pressure air tube is moveable along the elongated vacuum member side wall opening, so that the longitudinal position of the high pressure air tube within the elongated vacuum member is variable.

6 Claims, 2 Drawing Sheets

PORTABLE HAND VACUUM FOR PICKING UP SMALL METAL PARTICLES

BACKGROUND OF THE INVENTION

This invention relates to hand held vacuum devices for picking up and holding debris.

Heretofore, hand held vacuums for picking up and holding debris such dust, lint and dirt have been made small and light so that a user can easily use them with one hand and reach and clean out small places. In the past such hand held vacuums have included a rotary air pump driven by an electric motor and an electric cord from the motor is plugged into an available AC power line. With the availability of small, relatively light high powered electric motors, such hand held vacuums can be made rather powerful and may be driven by a one third or one half horsepower motor and still not be too heavy to be used readily with one hand. There are several problems that arise from the use of such hand held vacuums. For one the centrifugal pump is usually in the direct flow path of the debris that is drawn into the device before it reaches an attached catch bag and pieces of hard debris like pieces of metal can impact on the pump and damage it. Also, the electric motor that drives the pump can generate sparks and so the vacuum cannot be used freely in an environment of combustible or explosive fumes. These limitations of prior hand held vacuums are avoided by a vacuum device incorporating features of the present invention.

SUMMARY OF THE INVENTION

The air powered vacuum according to the present invention is essentially a two part assembly including an elongated tubular vacuum member (the vacuum tube) that has a vacuum intake at one end and an air bag attached at the other end and an external high pressure air assembly including a valve that connect to a flexible high pressure air hose from a source of high pressure air. The valve controls the flow of high pressure air through a small rigid high pressure tube that enters the side of the vacuum tube and discharges high pressure air inside of it toward the catch bag. The catch bag is porous and so the high pressure air discharges from the vacuum tube into the catch bag and flows through the the pores in the catch bag out into the atmosphere. In the process, a substantial vacuum is created in the vacuum tube, particularly between the point of high pressure air injection and the vacuum intake. The high pressure air flow in the vacuum tube aspirates the inside of the tube between the point of discharge of the high pressure air and the vacuum tube intake and ambient air enters the aspirated area through the intake drawing in with it pieces of metal and debris that flow through the vacuum tube and are caught in the catch bag.

Some of the principles of operation of this vacuum device are also found in the well know jet pump also called an injection pump or a vapor entrainment pump. The earliest and best know of the jet pumps is the steam jet pump which uses a jet of high pressure steam to pump water. Jet pumps are in a class of pistonless pumps or impellarless pumps usually used for pumping liquids and they are distinguished from direct liquid displacement pumps like lift pumps and suction pumps.

The two classes of entrainment pump most commonly used are those using high pressure, high velocity pumping fluids like steam for pumping water and those using low velocity rarefied vapors like oils, where the ultimate vacuum is equal to the ambient vapor pressure of the oil. These are sometimes called oil boost pumps and are used for drawing down a high vacuum in a small space.

The principal of the steam injector pump has been applied in a great variety of vapor entrainment pumps for producing a high vacuum. For that purpose a vapor gas is ejected from an injector jet passes through an open gap into a receiving jet or diffuser and molecules of gas to be pumped enter that stream and are carried away through a diffuser. Clearly, these are high vacuum gas pumps and are used to produce a high vacuum. They are not used to pick up and remove coarse debris from an ambient environment.

It is an object of the present invention to provide a hand held vacuum device for picking up small pieces of dense material such as metal from an ambient environment and catching the pieces in a retainer.

It is another object to provide such a hand held vacuum that does not have any moving parts.

It is another object of the present invention to provide such a hand held vacuum that does not have any electrically driven parts.

These and other objects and features of the present invention will be apparent from the accompanying description of the embodiments of the invention taken in conjunction with the drawings.

EMBODIMENTS OF THE INVENTION

Figures 1, 2, 3:
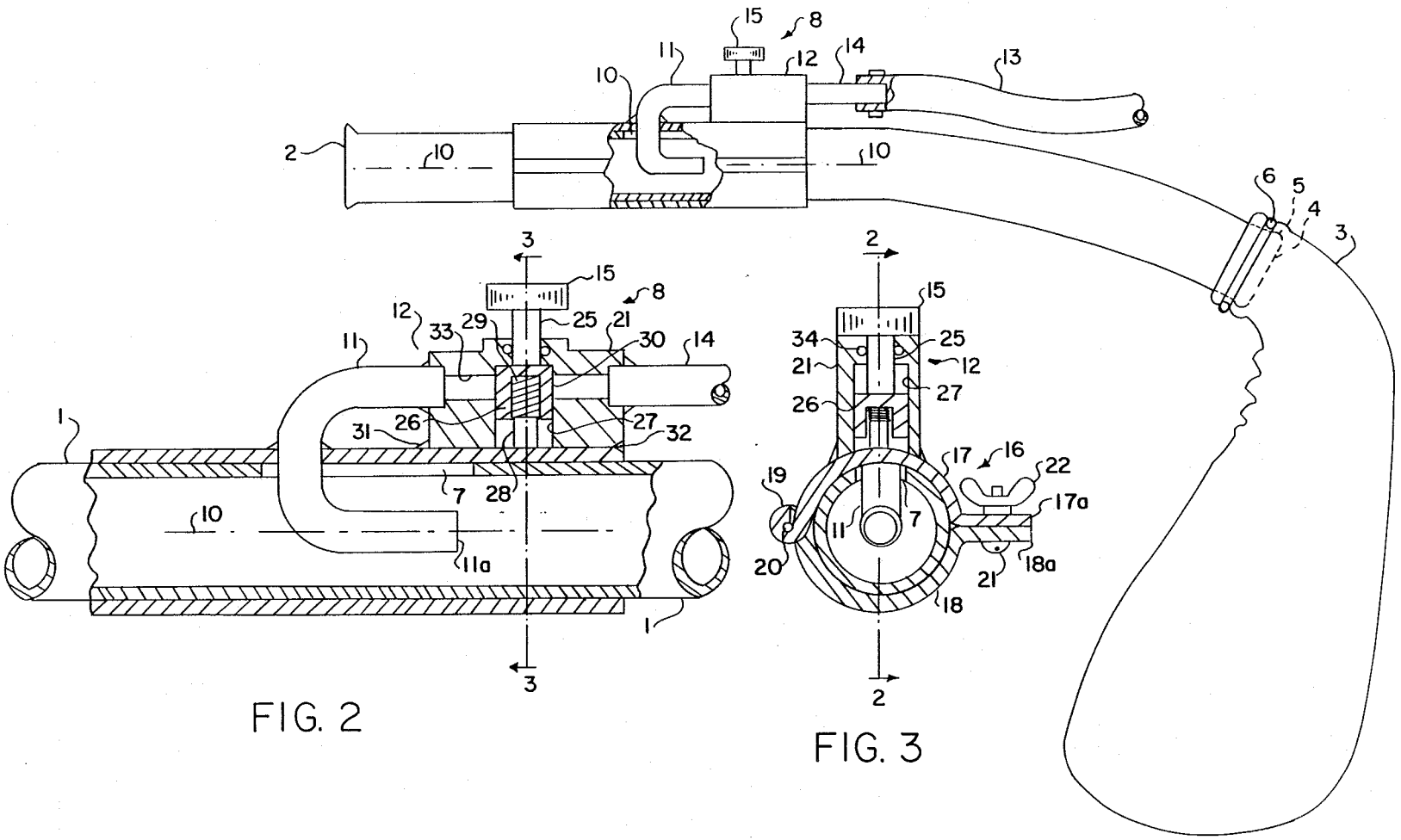
FIG. 1 is a side view of a hand held, air driven vacuum device according to the present invention.
FIG. 2 is an enlarged side cross section view of the vacuum of FIG. 1 showing the high pressure air parts that project into the vacuum tube, the high pressure air valve being shown closed, and the connection from the valve to the flexible high pressure air hose.
FIG. 3 is a cross section view of the valve, injector and vacuum tube taken as shown in FIG. 2 and viewed longitudinally along the vacuum tube and shows the valve open.

The entire hand held, air powered vacuum device is shown in FIG. 1. The elongated tubular vacuum member (vacuum tube) 1 is essentially a cylindrical tube of constant diameter providing a vacuum intake 2 at the input end and having a catch bag 3 attached to the output end 4. The output end may be flaired or rolled to provide a bead 5 that the neck of the catch bag fits over and is secured to by a snap ring 6. This attachment for the catch bag is such that it can be readily disconnected from the vacuum tube, emptied and then reattached for use again.

A vacuum is produced in the vacuum tube 1 by a high pressure air jet that is introduced into the vacuum tube through an opening such as opening 7 in the side of the tube. The high pressure jet of air is supplied by the high pressure air feed assembly 8. It feeds and controls a jet of high pressure air that issues from high pressure tube 11 that enters through the opening 7 and turns parallel to the geometric axis 10 of the vacuum tube opening in the direction of the output end 4. High pressure tube 11 connects to air flow valve 12 that in turn connects to high pressure flexible air hose 13. Jet tube 11 is rigid and is fixedly attached to valve 12 and a straight piece of rigid high pressure tubing 14 leads from valve 12 to hose 13.

In operation, the hose connects to a source of high pressure air that may supply air at several hundred PSIG and air power equivalent to several horse power. The hose is long enough to reach any point of operation intended for the vacuum. The user brings the intake end 2 of the vacuum tube close to an area to be vacuum cleaned while holding the vacuum tube at the high pressure air assembly 8 (particularly valve 12) with one hand, operates the valve control button 15 with the thumb of that hand. All this can be done with one hand and while so holding the device the user presses the valve control button 15 releasing high pressure air from the jet tube 11.

The jet of high pressure air flows down vacuum tube 1 and into catch bag 3 clearing anything from the tube and carrying it into the bag. The jet also entrains air in the tube creating a partial vacuum in the portion of the tube between the jet and intake 2. That vacuum draws loose particles of debris and dirt and even small pieces of metal and other particles of dense material into the vacuum tube intake and past jet tube 11 where the debris and particles are driven even more forcefully by the jet of air issuing from tube 11 down the vacuum tube and into the catch bag. The catch bag holds all such particles while allowing the air flow into it to flow out through pores in the bag into the atmosphere.

The high pressure rigid jet tube 11 maybe be sealed at the opening 7 to the vacuum tube wall so that ambient air is not drawn into the vacuum tube through that opening around the jet tube. For that purpose, it is quite easy to solder, braze, weld or otherwise attach and seal the jet tube to the opening in the side wall in the vacuum tube and the technique of attaching and sealing will depend upon the materials involved. For example, if the vacuum tube is aluminum and the jet tube 11 is copper, then the jet tube can be brazed to the opening in the vacuum tube. If both tubes are plastic then the jet tube can be bonded to the opening using a suitable bonding epoxy. On the other hand if both tubes are steel then the jet tube would be welded to the opening in the vacuum tube.

SECOND EMBODIMENT

For some applications it may be preferred to change the jet tube or to move the jet tube axially along the vacuum tube to improve performance. In either case, another type of seal has to be provided to seal the opening in the side of the vacuum tube that accommodates the jet tube. For example, the sealing structure shown in FIGS. 1, 2, and 3 provides an elongated opening 7 in the side wall of the vacuum tube so that the entire high pressure air feed assembly 8 including jet tube 11, valve 12 and flexible hose 13 can be detached from vacuum tube 1. In this example, the opening 7 is an elongated slot and that slot is covered by a sealing sleeve assembly 16 that is fixedly attached to valve 12.

Sealing assembly 16 includes upper and lower sealing half cylinders 17 and 18 that are hinged together along one side at hinge 19 so that they may open and close around the section of the vacuum tube that contains the side opening 7. This seal is shown closed in FIGS. 1 to 3, as the upper and lower half cylinders of the seal are closed and clamped around vacuum tube 1 as shown particularly in FIG. 3. When closed, the two half cylinders may be secured along the opposite side from hinge 19 along their respective flanges **17*a* and 18*a* by bolts and wing nuts such as bolt 21 and wing nut 22. Clearly, this seal merely covers the opening 7 in the vacuum tube and does not completely prevent any ambient air from entering the tube through the opening. However, the amount of ambient air that may flow through opening 7 is negligible compared with the amount entering the vacuum tube intake 2. With this construction, the entire high pressure air feed and control assembly 8, including the jet tube, valve, flexible hose and seal can be removed from the vacuum tube by simply opening the wing nuts 22, pivoting the lower half cylinder 18 clockwise, as shown in FIG. 3**, and then lifting the assembly off of the vacuum tube. Then, a new high pressure assembly may be attached including a smaller or larger jet tube or even one connected to a higher pressure source of air pressure and the change is accomplished quickly and easily.

Another feature of the high pressure assembly and seal shown in FIGS. 1 to 3 is that the axial position of the jet tube 11 along axis 10 of vacuum tube 1 can be varied to an extent. Since opening 7 is a slot, the jet tube can go through that slot at any point along the slot. In FIG. 2 it goes through the slot at the forward end of the slot. The high pressure assembly could be positioned so that jet tube 11 went through the slot at the rear end of the slot and so would position the jet further downstream in the vacuum tube. Said variation is sometimes desired to optimize the entrained air power that is produced within the vacuum tube. In particular, the distance from the point of injection of the high pressure air jet at the end **11*a* of the jet tube to the discharge end 4 of the vacuum tube may be varied to optimize that power. The optimum distance from the end of the jet tube at 11*a* to the end of the vacuum tube at 4 will depend on the flow resistance introduced by the catch bag and that will depend upon how full the catch bag is and its porosity. The elongated opening (slot) 7** allows positioning the jet tube axially along the vacuum tube.

Valve 12 may be just about any sort of push, toggle or twist valve that opens and closes a high pressure fluid passage. Here, a spring loaded push button operated valve is shown. As shown particularly in FIG. 2, the stem 25 from control button 15 connects to a piston 26 in cylinder 27 in which a central post 28 projects axially from the bottom of the cylinder. The piston is hollow and the post fits up into the hollow part of the piston and a coil spring 29 is captured in the hollow piston on top of the post. A groove on the high pressure side of piston 26 at all times feeds high pressure air to the top and bottom faces of the piston so that the piston does not have to act against pressure, but substantially only against spring 29.

The the valve body 21 is sealed to the top half cylinder 17 of seal 16 by weld seams 31 and 32 which also seals the valve cylinder at the bottom. The top part of the valve cylinder connects to a transverse passage 33 through the body of the valve and jet tube 11 connects and seals to that passage at one end and an high pressure input tube 14 connects to the other end and the high pressure hose 13 connects to tube 14. An O ring seal 34 may be provided in the valve housing to stop flow of high pressure air out of the valve past the stem 25.

Valve 12 is shown closed in FIG. 2, the control button being extended upward by the action of the spring and is shown opened in FIG. 3 where the piston is depressed by the button and the spring is compressed and so the piston does not block the flow through the hole 33 between the input tube and the jet tube. This type of valve is but one of any number of suitable valves that could be used to control the flow of high pressure air from high pressure flexible hose 13 to jet tube 11 that discharges within vacuum tube 1 as described.

Third Embodiment

Figure 4:
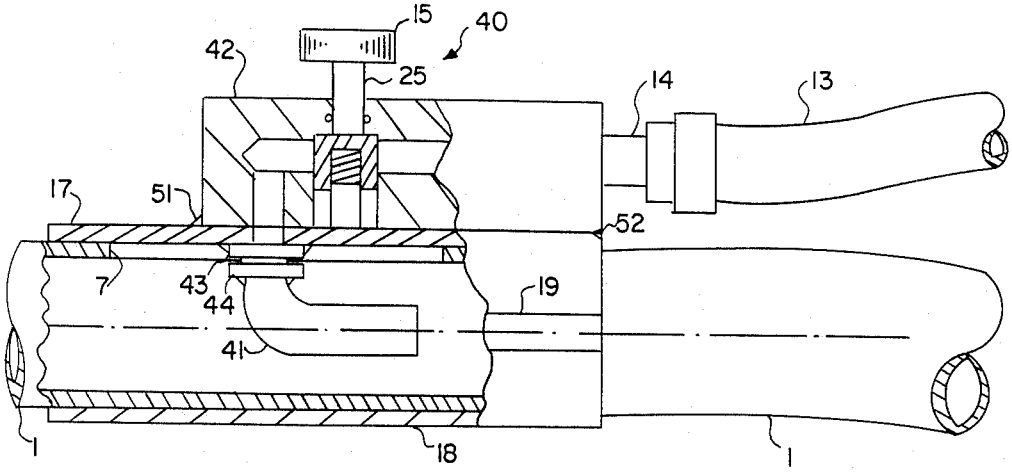
FIG. 4 is an enlarged side view in cross section showing another structure of the valve, injector and seal that seals the opening of the side wall of the vacuum tube into which the high pressure injector tube projects.

Another embodiment similar to the embodiment shown in FIGS. 1 to 3 is shown in FIG. 4. Here, the valve 42 body has a slightly different configuration and the jet tube 41 is readily removed from the valve body. For that purpose, a first tube fitting 43 is fixed and sealed to the upper half cylinder 17 of seal 16 and a second fitting 44 is attached to and sealed to jet tube 41 for threadably engaging the first fitting. By these threaded fittings the jet tube is attached to the valve body. In the valve body, a connecting passage 45 is provided perpendicular to transverse passage 46 that goes through the piston cylinder. These two passages meet in the valve body and passage 45 connects to jet tube 41 through fittings 43 and 44. Thus, the flow of high pressure air from flexible hose 13 is into the valve housing through passage 46 through the top of the piston cylinder when the piston is depressed and into a passage 45 that feeds jet tube 41. The advantage of the embodiment shown in FIG. 4 is that different size jet tubes can be attached to the same valve assembly and all other advantages of the embodiment shown in FIGS. 1 to 3 are also available.

Fourth Embodiment

Figure 5:
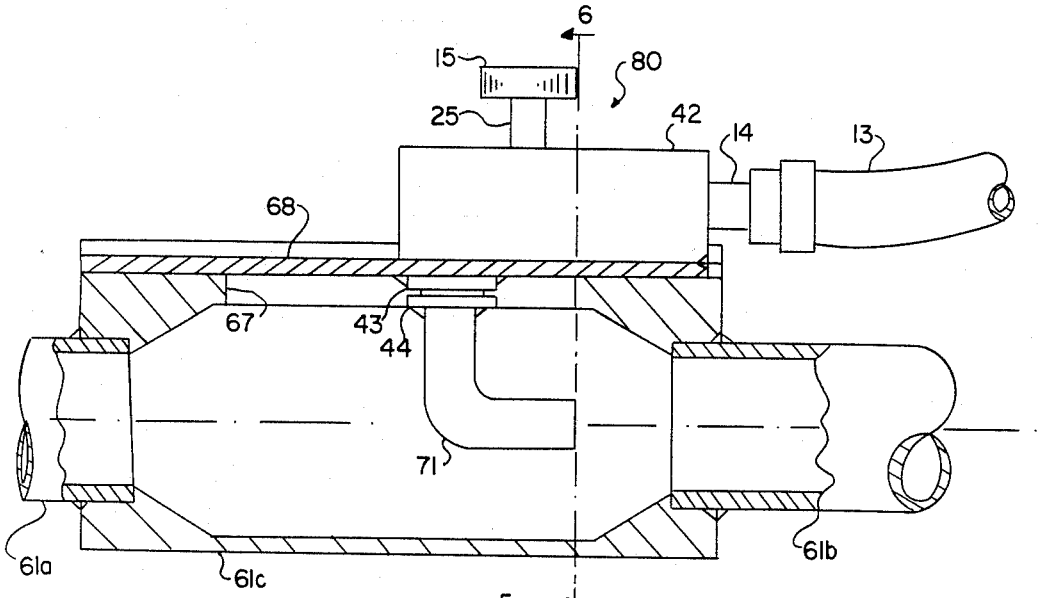
FIG. 5 shows another embodiment wherein the portion of the vacuum tube into which the injector projects is of larger cross section area than other parts of the vacuum tube.
Figure 6:
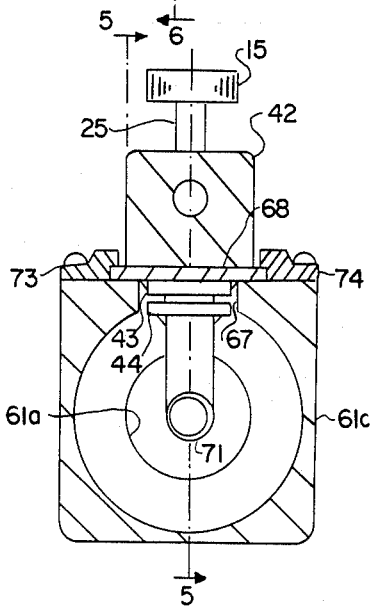
FIG. 6 is a cross section view taken as shown in FIG. 5 viewed longitudinally along the vacuum tube.

Another embodiment that includes all features of the embodiment shown in FIG. 4 is illustrated in FIGS. 5 and 6. Here, the vacuum tube is not a continuous unitary piece tube, but includes a front section 61*a* that has an intake 62 (not shown) and a rear section 61*b* that attaches to a catch bag (also not shown). These two sections 61*a* and 61*b* are connected by a vacuum tube section 61*c* of larger cross section diameter. The side opening 67 into the vacuum tube is in section 61*c* and is an elongated opening or slot that serves the same function and purpose as opening 7 in the embodiment in FIGS. 1 to 4. The valve 42 and the connection to it are the same internally as in the embodiment of FIG. 4 including connections to flexible hose 13 and pipe fittings 43 and 44 for connecting jet tube 71 to the valve. However, here, the opening 67 is sealed by a flat plate 68 that slides longitudinally along the top of section 61*c* in a track defined by longitudinal brackets 73 and 74. The plate is long enough so that at any position of jet tube 71 longitudinally along slot 67, the plate covers the slot.

The high pressure air feed and control assembly 80 including valve 42, jet tube 71 and sealing plate 68 can be removed from section 61a of the vacuum tube by removing the track brackets 73 and 74 and then lifting the assembly off of the vacuum tube. One purpose of the larger diameter section of vacuum tube 61*c* is to provide a greater dimensional clearance around the jet tube 71 for the flow of particles drawn into the vacuum tube. Another function is to provide a venturi shape in the vacuum tube at the junction of sections 61*c* and 61*b*. Such a venturi shape tends to generate a lower aspiration pressure (a deeper vacuum) and the larger section 61*c* acts as a vacuum plenum chamber and so the flow of ambient air to the forward section 61*a* is stronger and steadier. A disadvantage of the larger plenum area is that particles and debris will flow more slowly through it.

Conclusions

The several embodiments of the present invention as described herein are all air powered, hand held vacuum devices that can be held and operated by the user with one hand and all serve well to provide a powerful vacuum for cleaning debris and particles from small places, even particles of metal and other dense materials, all without any driven or mechanically rotated parts, and without electric power, for reasons already described herein. Clearly, those common features may be incorporated in other embodiments that include other variations and/or combinations of features described herein without deviating from the spirit and scope of the invention as set forth in the accompanying claims.

What is claimed is:

1. A hand held vacuum device for picking up and containing debris in an ambient environment comprising, (a) an elongated tubular vacuum member having an input end and an output end, (b) said input end having an opening therein suitable for the movement of debris into said opening under the influence of the flow of ambient air flowing into said opening, (c) said output end having means attached thereto for receiving said debris that flows into said input end, and (d) means for discharging high pressure air into said elongated vacuum member at a point therein between said input and output ends, whereby said high pressure air discharged flows to said output end and draws ambient air into said input end, the flow of said ambient air into said input end being sufficient to carry said debris into said input end, through said vacuum member and into said means for receiving said debris.

(e) said means includes a high pressure air tube for carrying said high air pressure flow into said vacuum tube, (f) an elongated opening in a side of said vacuum tube through which said high pressure tube projects into said vacuum tube, (g) means are provided for sealing between said high pressure air tube and said vacuum tube opening and (h) said rigid high pressure air tube is moveable along said elongated said vacuum tube side wall opening (i) whereby the longitudinal position of said high pressure air tube within said vacuum tube is variable.

2. A device as in claim 1 where, (a) said means for sealing includes a cover that covers said elongated vacuum tube opening and (b) said cover is fixedly attached and sealed to said rigid high pressure air tube.

3. A device as in claim 2 including, (a) means for securing said cover to said vacuum tube, (b) whereby ambient air flow into said vacuum tube through said opening is minimized.

4. In a jet pump vacuum device for picking up debris including an elongated tubular vacuum member having an input end and an output end and a high pressure air tube for discharging a jet of high pressure air into said elongated vacuum member at a point therein between said input and output ends, whereby said high pressure air discharged flows to said output end and draws ambient air into said input end, the flow of said ambient air into said input end being sufficient to carry said debris into said input end, through said vacuum member and out said output end, the improvement comprising, (a) means for varying the position of said point of discharge of high pressure air within said elongated vacuum member.

5. A device as in claim 4 wherein, (a) an elongated opening is provided in a side of said elongated vacuum member through which said high pressure tube projects into said elongated vacuum member, (g) means are provided for sealing between said high pressure air tube and said vacuum member opening and (h) said high pressure air tube is moveable along said elongated vacuum member side wall opening (i) whereby the longitudinal position of said high pressure air tube within said elongated vacuum member is variable.

6. A device as in claim 5 including, (a) means for securing said cover to said elongated vacuum member, (b) whereby ambient air flow into said elongated vacuum member through said opening is minimized.

* * * * *